US005418024A

United States Patent [19]

Inashvili

[11] Patent Number: 5,418,024

[45] Date of Patent: May 23, 1995

[54] METHOD OF PRODUCING ART PRODUCTS, AND ART PRODUCT PRODUCED BY THE SAME

[76] Inventor: Alexander Inashvili, 199 Bay 32 St., Brooklyn, N.Y. 11214

[21] Appl. No.: 29,376

[22] Filed: Mar. 10, 1993

[51] Int. Cl.[6] ..... B44F 1/06

[52] U.S. Cl. ..... 428/38; 156/63; 427/534; 434/84

[58] Field of Search ..... 428/38, 913.3; 427/534; 434/84; 156/63

[56] References Cited

U.S. PATENT DOCUMENTS 4,869,940 9/1989 Shoshani ..... 428/38

5,082,703 1/1992 Longobardi ..... 428/38

*Primary Examiner*—Henry F. Epstein

*Attorney, Agent, or Firm*—I. Zborovsky

[57] ABSTRACT

An art product is produced by providing a carrier having a metal layer, an adhesive layer and a substrate, applying a protective material on portions of the metal layer which must be retained in the final art product, etching the remaining portions of the metal layer to expose portions of the adhesive layer, and painting the exposed portions of the adhesive layer with a painting material which binds with the adhesive.

10 Claims, 2 Drawing Sheets

METHOD OF PRODUCING ART PRODUCTS, AND ART PRODUCT PRODUCED BY THE SAME

BACKGROUND OF THE INVENTION

The present invention relates to a method of producing art product involving images on metals, and an art product produced by the method.

It is know to produce art products on metals by engraving. The known methods involves providing a metal substrate, making an image on the metal substrate, engraving corresponding portions of the metal substrate with engraving tools, and then painting corresponding portions of the engraved metal substrate. While this method can produce art products of high aesthetic values, it is quite complicated and labor-consuming, and also limited as to its versatility and production of art products in reasonably great numbers. It is to be understood that further improvements of such methods are desirable.

SUMMARY OF THE INVENTION

Accordingly, it is an object of the present invention to provide a method of producing of art products, and an art product, which are further improvements of existing method and products.

In keeping with these objects and with others which will become apparent hereinafter, one feature of the present invention resides, briefly stated, in a method which includes providing a carrier having a metal layer, and adhesive layer and a substrate layer, making an art image of an outer surface of the metal layer, applying an etching-resistant protective material in correspondence with the image on portions of the outer surface of the metal layer which will be present in the final art product, etching remaining uncoated portions of the metal layer to exposed portions of the adhesive layer, and painting the exposed portions of the adhesive layer with a painting material which firmly binds with the adhesive.

The thusly produced art product includes a metal layer with partially removed portions and exposed ahesive layer portions, and a painting material applied onto the exposed adhesive layer portions and bonded with it, both layers being arranged on the substrate layer, which can be transparent.

The novel features of the present invention are set forth in particular in the appended claims. The invention itself, however, both as to its construction and method of manufacture, will be best understood from the following description of preferred embodiments, which is accompanied by the following drawings.

DESCRIPTION OF PREFERRED EMBODIMENTS

Figure 1:
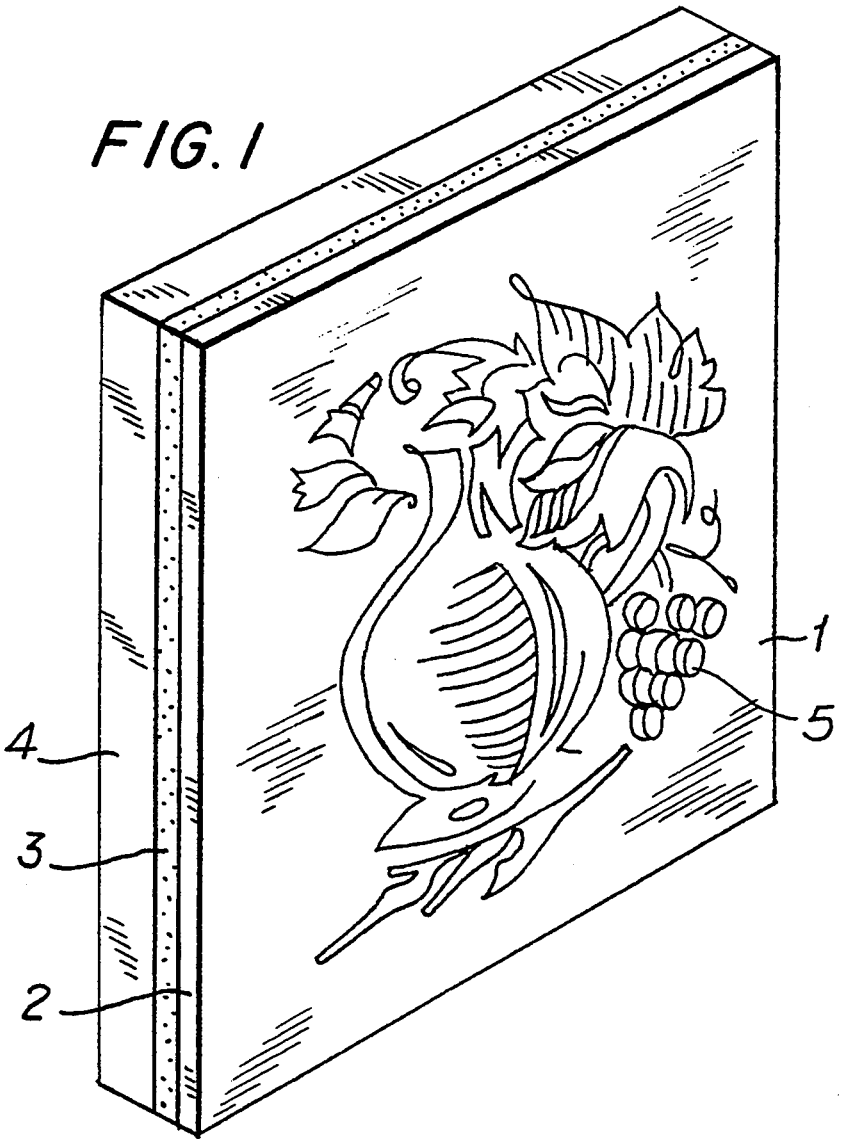
FIG. 1 is a perspective view of a carrier for an art product in accordance with the present invention.

In accordance with the present invention in order to produce an art product, a carrier is provided. The carrier has a metal layer 2 which can be composed for example of copper, an adhesive layer 3 which can be composed for example of a plastic adhesive material such as epoxy resin adhesive, and a substrate layer 4 which can be composed of any material such as plastic material.

In accordance with the inventive method, first of all an art image is made on the outer surface of the metal layer 2 as indentified with reference numeral 5. The art image can be made for example by pencil, pen and the like, or produced by a photographic method by applying a photosensitive film of the outer surface of the metal layer and then projecting on the film an image to expose corresponding portions of the film.

Figure 2:
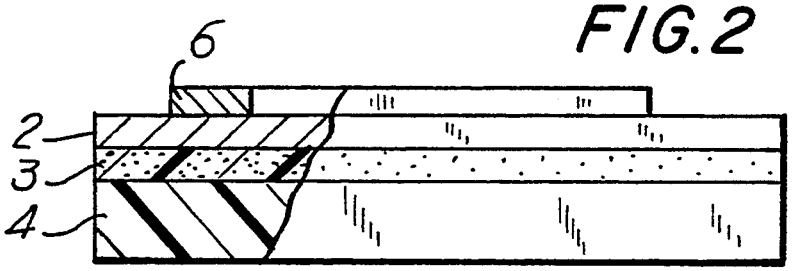
FIGS. 2–6 are views showing successive steps of a method of producing art products in accordance with the present invention.

An etching-resistant protective layer 6 is then applied in correspondence with the art image 5 on the outer surface of the metal layer 2 so as to cover corresponding portions of the outer surface of the metal layer. The layer 6 can be composed, for example, of varnish which contains ethyl acetate toluol or acetone. The layer is dried then for several hours. This is shown in FIG. 2.

Figure 3:
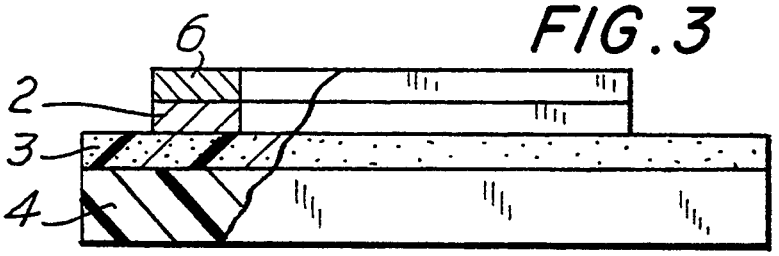
Figure 4:
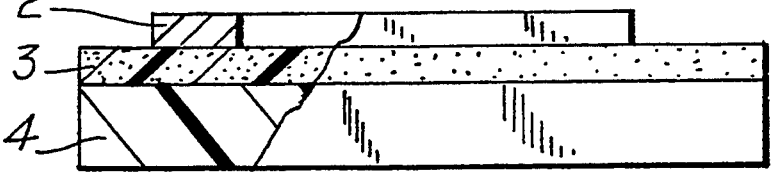

The carrier is then subjected to etching as shown in FIG. 3. It is introduced for example into a tray, then an etching solution is poured into the tray and agitated, the solution is kept for several hours, then the carrier is removed and rinsed. The etching solution can be composed for example of ferric chloride in a solvent. As can be seen from FIG. 3 the etching solution erodes and removes the metal of the metal layer in the areas which are not protected by the protective material 6 so as to form cavities in the metal layer 2 and to expose the outer surface of the adhesive layer 3 in the remaining areas on the bottoms of the cavities. Then as shown in FIG. 4 the protective layer 6 is removed, for example by a 50%–50% mixture of terpentine and acetone.

Figure 5:
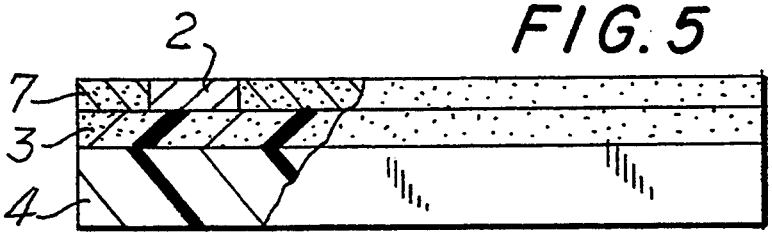
Figure 6:
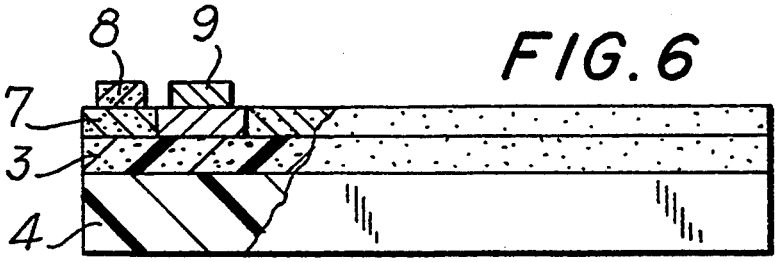

As can be seen from FIG. 5, then a painting material is applied on the outer surface of the exposed portions of the adhesive layer 3. The painting material can be for example a mixture of 30% acetone with 70% alcohol with corresponding pigments such as color inks for fountain pens ("Durnham's Instant Color which is color blue, Standard glass color "Pebeo", or pilot ink of any color for pen, etc). The painting material 7 fills the cavities in the metal layer and firmly binds with the adhesive layer 3. In particular, it dissolves microscopic areas of the adhesive, enters the thusly produced microcavities, and produces strong bond with the adhesive in addition to the required color. Then follows the drying step.

Thus, an art product is produced, in which the portions of the metal layer 2 which remain after etching form the art image, while the painting material on the portions of the adhesive layer produces a background.

Thereafter the face surface of the art product can be polished, for example with a felt disc of a disc grinder with the use of a polishing compound such as car care product white polishing compound. As a result the painting material obtain a glance, while all sharp corners of the metal portions are smoothed and also obtain a glance. Also, the polishing removes an oxide layer from the metal portions.

It is possible to provide additional images 8 on the background composed of the painting material applied on the adhesive. This can be done by using for example enamels on the outer surface of the painting material. It is also possible to apply a decorative material 9 on the metal portions, for example silver or gold, on the outer surface of the metal portions. This can be done for example by electrodeposition of silver, gold etc. on the metal portions. For silver, the intitial material can be $AgNo_3$ and ammonium thiocyanate in which the carrier is immersed for 1–4 hours and 10–40 hours correspondingly. The outer surface of the decorative material can be additionally completely or locally painted if desired.

In accordance with another feature of the present invention, the adhesive layer 3 and the substrate 4 can be transparent. In this case both the metal portions and the adhesive portions painted with the painting material are visible through the transparent adhesive and substrate layers. The thusly produced article exactly resembles stained-glass art products.

The invention is not limited to the details shown since various modifications and structural changes are possible without departing in any way from the spirit of the invention.

What is desired to be protected by Letters Patent is set forth in particular in the appended claims.

I claim:

1. A method of producing an art product, comprising the steps of providing a carrier including successively arranged a metal layer, an adhesive layer, and a substrate layer;

making an art image on an outer surface of the metal layer;

applying on the outer surface of the metal layer an etching-resistant protective material only on those portions of the metal layer in accordance with the art image, which portions in a final art product must be formed of exposed metal;

etching the metal layer so that the metal in remaining portions which are not covered by the protective material, is removed, cavities in the metal layer are produced, and the adhesive layer is exposed on bottoms of the cavities;

painting the carrier so that a painting material fills the cavities of the metal layer and is applied directly on the adhesive layer in areas when the metal is removed and adheres to the adhesive layer, so that said portions formed of exposed metal form an art image while the painting material in the cavities of the metal layer forms a background.

2. A method as defined in claim 1, and further comprising the step of removing the protective material after said etching step and before said painting step.

3. A method as defined in claim 1, wherein said painting is performed so that the painting material partially and locally dissolves an exposed surface of the exposed adhesive layer, penetrates into dissolved portions of the exposed surface and thereby is bonded with the adhesive layer.

4. A method as defined in claim 1, and further comprising the step of polishing of a face surface of the product after said painting.

5. A method as defined in claim 1, wherein said substrate layer is transparent so that the produced art product is a stimulated stained glass.

6. A method as defined in claim 1, and further comprising the step of applying additional decorative material on the outer surface of the metal layer of the produced art product.

7. A method as defined in claim 6, wherein said additional decorative material is selected from the group consisting of gold and silver.

8. An art product, comprising a metal layer with portions removed by etching so as to form cavities and further portions retained in accordance with a desired image of a produced art product;

an adhesive layer arranged under said metal and having areas exposed on the bottoms of said cavities;

a substrate layer located under said adhesive layer;

a painting material filling said cavities and applied on said exposed areas of said adhesive layer and bonded with said adhesive layer, so that said further retained portions of said metal layer forms an art image while said painting material in said cavities of said metal layer forms a background.

9. An art product as defined in claim 8, wherein said substrate layer is transparent so that the art product is a stained-glass product.

10. An art product as defined in claim 8, and further comprising a decorative material applied on an outer surface of the metal layer of the produced art product.

* * * * *